US008378193B2

(12) United States Patent
Culver et al.

(10) Patent No.: US 8,378,193 B2
(45) Date of Patent: Feb. 19, 2013

(54) CONTOURED FINGER PICK FOR STRINGED INSTRUMENTS

(76) Inventors: Matthew A. Culver, Redding, CA (US); Patrick Joseph Tennant, Redding, CA (US)

( * ) Notice: Subject to any disclaimer, the term of this patent is extended or adjusted under 35 U.S.C. 154(b) by 68 days.

(21) Appl. No.: 12/928,033

(22) Filed: Dec. 1, 2010

(65) Prior Publication Data

US 2012/0137852 A1 Jun. 7, 2012

(51) Int. Cl.
*G10D 3/16* (2006.01)

(52) U.S. Cl. ..... 84/320

(58) Field of Classification Search ..... 84/320–322
See application file for complete search history.

(56) References Cited

U.S. PATENT DOCUMENTS 4,879,940 A 11/1989 Pereira
5,323,677 A 6/1994 Knutson

OTHER PUBLICATIONS

ProPik Fingertone, (Advertisement) Guitar World Acoustic, No. 26, 1998, p. 90.
Alaska Pik (Advertisement) Fingerstyle Guitar, May/Jun. 1998, No. 27, p. 34.
Coimbra pick, fernandezmusic.com/Portuguesemethodpage2.html.
www.fredkellypicks.com, Delrin Freedom Finger picks.

*Primary Examiner* — Kimberly Lockett

(57) ABSTRACT

A pick worn on the finger or thumb of a player of a stringed instrument to aid in the plucking of the strings. The pick rests comfortably like a saddle upon the upper surface of the finger because it's large inner surface mimics the unique contour of the finger or thumb, enabling the pressure required to secure it to be distributed equally on the finger. It has a picking edge that is placed at a point on the finger where the string naturally first contacts the finger, making for a very natural playing experience. The angle of orientation of the picking edge allows the string to move easily and quietly across the striking surface, reproducing the sound of a traditional flat pick. It's unique design holds it place without slipping using wide and thin elastic band which also eliminates unwanted noise from inadvertently contacting adjacent strings.

15 Claims, 7 Drawing Sheets

CONTOURED FINGER PICK FOR STRINGED INSTRUMENTS

References to Related Prior Art

Figure 1:
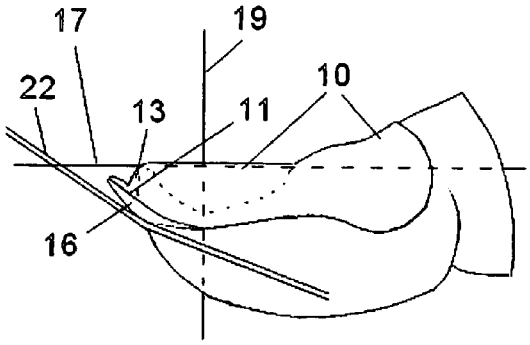

| Patent No. | Inventor | Reference Source |
|---|---|---|
| 7,375,268 | Thornhill | USPTO |
| 7,312,386 | Sielaff and Sielaff | USPTO |
| 5,323,677 | Knutson | USPTO |
| 4,843,942 | Ishizuka | USPTO |
| 4,879,940 | Pereira | USPTO |
| 3,739,681 | Dunlop | USPTO |
| NA | unknown | ProPik Fingertone, (Advertisement) Guitar World Acoustic, No. 26, 1998, p. 90 |
| NA | unknown | Alaska Pik (Advertisement) Fingerstyle Guitar, May/June 1998, No. 27, p. 34 |
| NA | unknown | Coimbra pick, fernandezmusic.com/Portuguesemethodpage2.html |
| NA | unknown | Fred Kelly Freedom Pick, www.fredkellypicks.com |

BACKGROUND OF THE INVENTION

In the world of guitar players there are those who strum and/or pick using a single, typically triangular shaped flat pick which is held by the thumb and index finger. Then there are the players who mostly finger pick and do not use the aforementioned pick, but use the thumb and fingers independently to pluck individual strings. These "finger pickers" usually use no artificial aid at all but instead pluck the string with the flesh of their fingers. This finger picking style is the one which this invention addresses. Although most finger pickers do not use the wide selection of finger picks that are available, many have tried them in an attempt to reproduce the sound made by the triangular flat picks. These finger picks are generally made to be worn on the finger, and are usually one piece devices which contain both the part which secures the pick in place on the finger and the part that engages the instrument string as a single piece. A few others are two piece devices in which the pick, or striking edge, is held in place, usually by an elastic band which wraps around the finger. Most finger pickers have tried several different kinds of these picks and decided not to use them for the following reasons.

(1) The pick causes discomfort after a few minutes of wearing it.
(2) The pick interferes with the players natural playing style.
(3) The pick requires the player to learn a new picking style to adjust for the pick.
(4) The pick slips from it's position while in use and requires frequent readjustment.
(5) It doesn't produce the desired sound of a conventional flat pick
(6) Unwanted sounds are made when the user inadvertantly touches an adjacent.

Several recent related inventions have described the history of finger pick development, among them Thornhill in U.S. Pat. No. 7,375,268, who cites previous devices which address the problems of discomfort and slippage. Sielaff and others, in U.S. Pat. No. 7,312,386 also recount the problems when finger pick users cannot feel the string before plucking, the frustration with the sound that is produced, and the awkward, unnatural feeling of a pick on ones finger. He also does a good job of explaining the limitations of previous designs which fail to address the important issue of placement of the engaging edge of the pick at the natural point of contact of fingertips and/or fingernails with the string to be plucked.

Thornhill's solution possibly eliminates much of the discomfort of prior art designs and also addresses slippage. Sielaffs solution seems to make some headway in providing a way for a pick edge to contact the string in close proximity on the fingertip where the unaided fingertip would naturally make contact. This would solve the problem of having to relearn technique and would make progress in allowing a player to have greater control over the sound that is produced. Other recent designs have come closer to totally eliminating the discomfort problem while providing a device which allows the user to feel the string in the same way as bare fingered playing. The ProPik Fingertone pick comes closer than many earlier pick designs in providing a way for the string player to feel the string before plucking. An online internet search will reveal that many string players have found the Fred Kelly Freedom picks solve problems inherent in other designs. This particular pick can be worn in either an up or down orientation, and has the advantage that the inner surface which secures the pick to the finger more closely conforms to the features of a human finger, thus going far in eliminating discomfort. This pick when worn with the slotted side down allows the player to feel the string before it is plucked, and also allows a much more comfortable position due to the large surface area of the inner side of the top part of the pick to contact the upper surface of the finger. This pick design, particularly in this orientation, solves many prior problems.

Figure 46:
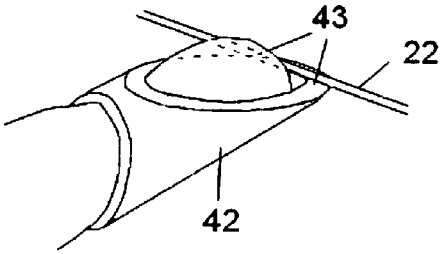

However, it still has one problem. This is a problem common to many other designs, also, more notably those which attempt to mimic the human fingernail as a striking edge. Not surprisingly, some string players do use their fingernails. It seems like a logical progression toward integrating a finger specific striking device with the advantages of the triangular flat pick. Fingernails have a hard narrow edge which can produce a crisp sound with better clarity and volume than bare finger string picking. But fingernails take a terrible beating when confronted with guitar strings which are usually made of metal. But there is another problem with fingernails which all previous designs seem to ignore. The natural shape of fingernails doesn't lend itself well to plucking a stringed instrument. A fingernail has a concave shape when it is directed toward the string, and when a string is plucked this concave shape causes a problem. This problem doesn't typically occur with those who use their fingernails, but with those who use finger picks which mimic the concave shape of finger nails. FIG. 46 shows an upside down view of the surfaces which contact together when a cylindrical fingernail-shaped pick (42) is used to pluck a string. The string encounters two points of contact (43) with the pick edge, the contact being at the surface of the narrow edge shown. This produces a scratchy sound as the player applies pressure to the pick and the edge slides along the string before it is released. Both the Freedom pick and the Alaska Pik finger picks have this design problem.

Several popular picks of related prior art incorporate a picking flange which is anchored to and originates from the dorsal or underside of the pick. This is the side which contacts the string. Some of these picks are the Thornhill pick, Dunlop pick, and the Fred Kelly Freedom pick. These are illustrated on the page of the prior art drawings and photos. The advantage of this design is that the instrument string only contacts the striking surface of the pick when the string is plucked. The finger or securing device is not contacted at all. Therefore there is no transition of the string across the junction of two different surfaces, and there is no possibility of a string catching or hanging. This produces a smooth movement of the string across the lower surface and usually results in a cleaner release of the string from the striking surface.

The disadvantage of this design is that finger contact with the string is lost, which is one of the first complaints of users of this type of pick. People who finger pick, especially new pickers, need to feel the placement of the string on the finger. It is crucial to the learning process to know where the strings are located so feeling the strings is important. This invention places the lower edge of the striking surface of the pick above the point on the lower finger surface where the string initially touches the finger. This enables the crucial feeling element for the string player.

Many of the "ease of use" problems of prior art designs originate in the failure to address the dynamics of plucking a string with a finger and thumb in the typical way in which this is done. This invention has come about as a result of an investigation into string picking dynamics, so that the design incorporated in this pick allows for a wonderfully natural feel and does not require the player to readjust his technique in order to produce a beautiful sound.

SUMMARY

The objective of this invention is to solve each of the above problems. This invention is a two piece guitar pick which is worn on a picking finger. This invention eliminates discomfort in two ways. First, a hard saddle with a smooth surface is contoured to the features of the top side of the finger or thumb and protects this sensitive part of the finger from abrupt hard corners and the friction of the elastic band. This special contour is entirely novel and allows an equal distribution of the pressure required to hold the saddle in place over a wide area so that the resultant pressure at any contact point of the saddle with the sensitive upper finger surface is greatly reduced over prior art. Second this special contour provides an additional advantage in that it keeps the pick from slipping from it's position while the instrument is played, thus alleviating pain from the friction of a sliding surface on this part of the finger.

This invention incorporates some very special design elements which do not interfere with the natural dynamics of finger picking. As a result the player can begin using the picks immediately without altering his playing technique and produce beautiful, warm sounds with clarity and volume. This is accomplished by consideration of three factors in plucking dynamics. These are shape and size of the striking piece, placement of the striking piece with respect to it's position on the finger, and the angle at which the underside surface of the striking piece is oriented with respect to the direction of travel of the string as it travels across the tip of the finger just before it is released. The particular combination of these new design elements will be detailed further in the description of the main embodiment.

Finally, this invention solves the problem of slippage in three ways. The special contour of the pick saddle to the surface features of the upper finger keeps the pick from moving laterally (sideways). Second, a wide elastic band with a naturally high coefficient of friction with the surfaces of both the smooth saddle on the upper finger and skin on the under side of the finger secures the saddle in place. Third, a unique design element in the construction of the finger cavity at the fingertip on the inner side of the pick saddle allows the pick to stay in place as it is pulled longitudinally in the direction of the hand by the wide elastic band.

Description—Main Embodiment

Figure 17:
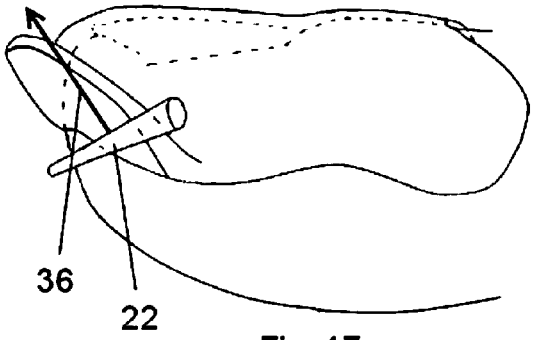
Figure 18:
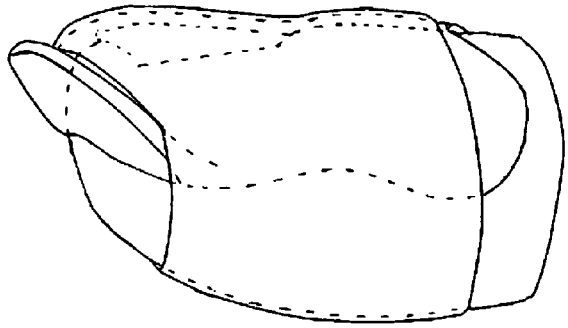

The main aspects of the invention is illustrated in FIGS. 1 through 7 and 17 through 22. It comprises a saddle (10), a pick flange (11) attached to the saddle, and a securing band (14). The preferred embodiment also incorporates a retaining strip (13) at the fingertip region of the saddle. FIGS. 1 through 7 show a thumb pick of the invention for a right hand thumb. FIGS. 17 and 18 show a pick made for a right hand index finger or forefinger.

Figure 12:
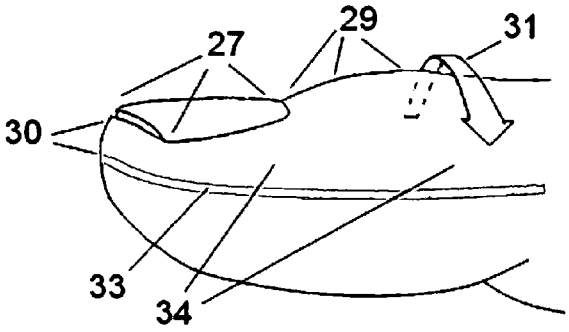
Figure 13:
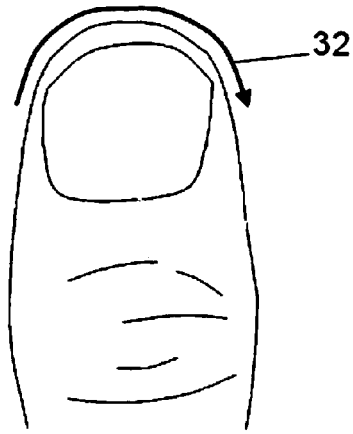

The saddle and pick flange are frequently discussed in this specification as separately formed parts of the invention because the method of manufacture of the invention used at the time of this writing begins with those parts as separate. The saddle has been thermally formed over a model of a human finger so that the inner surface which contacts the upper surface of the finger has the contour of a finger or thumb. This contour of the inner surface is such that the general features common to nearly all human fingers and thumbs as shown in FIGS. 12 and 13 are incorporated into this invention. Those features are the fingernail and thumbnail surfaces, the raised area posterior to the cuticle of both finger and thumb, the tapered curvature of the fingertip area as seen from the dorsal profile, and the curved, cup shaped area of the fingertip as it extends beyond the anterior view of the dorsal profile and proceeds downward toward the lower surface.

Figure 4:
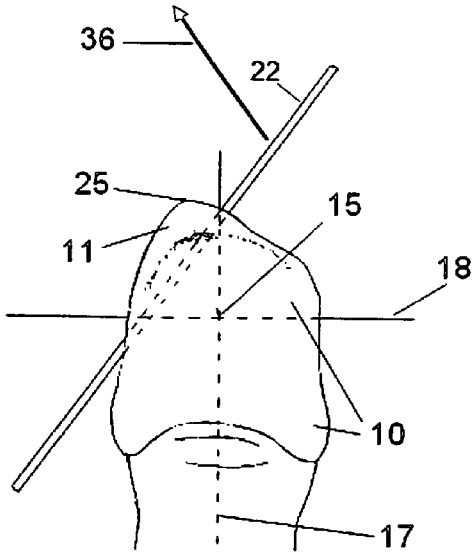
Figure 23:
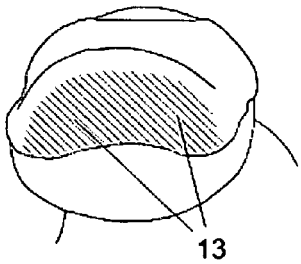
Figure 24:
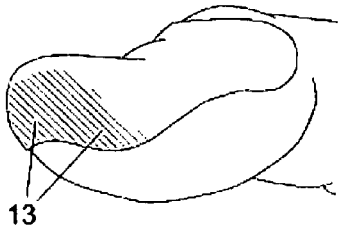
Figure 25:
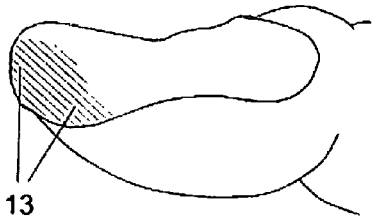
Figure 26:
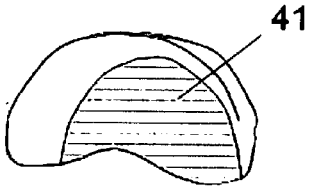
Figure 27:
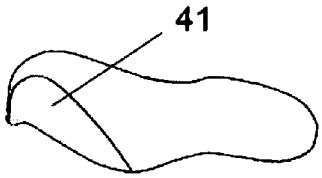
Figure 28:
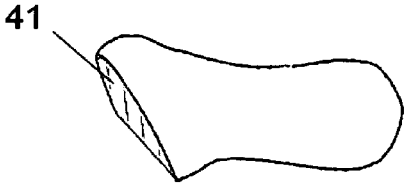

The saddle comprises a surface which covers a substantial part of the dorsal profile of the end digit of the finger or thumb as seen in FIG. 4. In addition, the preferred embodiment has the saddle extending over the end of the finger proceeding downward terminating on the lower surface of the finger as shown in FIGS. 23, 24, and 25. In these drawings the saddle is shown alone without the pick flange attached. The retaining strip (13), is shown as a shaded area.

Figure 29:
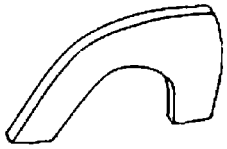
Figure 30:
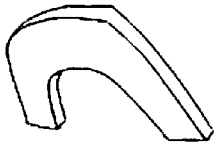
Figure 31:
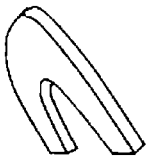
Figure 32:
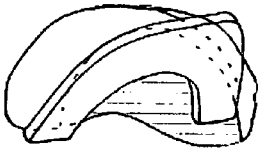
Figure 33:
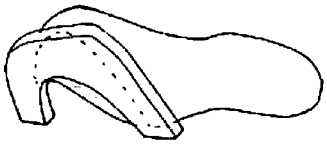
Figure 34:
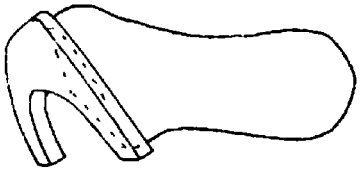
Figure 35:
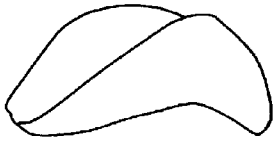
Figure 36:
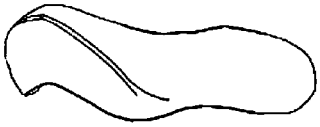
Figure 37:
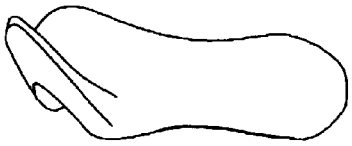

The digit shown in FIG. 4 is a thumb of a right handed guitar player. The pick flange can be seen which resembles the tip of a typical triangular flat pick and is the part of the invention which strikes the instrument strings. An unattached and unfinished pick flange can be seen in FIGS. 29, 30, and 31. The top view, or dorsal profile of the invention in FIG. 4 indicates an off center, or eccentric placement of the pick flange on the saddle. The direction in which the apex of the flange points is generally in the direction in which the string travels over the lower face, or striking surface (16) of the flange as it is plucked. FIG. 4 also shows the string as it would appear prior to being plucked, the arrows indicating it's direction of travel relative to the pick. The flange is attached to the pick saddle via one of several attachment means. At the time of this writing it is attached using a hot air welding process. The place of attachment of the pick flange is at the lower edge of the retaining strip. This preferred embodiment of the placement of the pick flange is such that it is offset vertically from the plane of the fingernail, and is critical to the novel and successful operation of this invention. In addition to the vertical displacement another critical aspect of the invention is the angular orientation of the striking surface of the flange. These aspects of the flange placement will be described with the help of accompanying illustrations in the following paragraphs.

Figure 5:
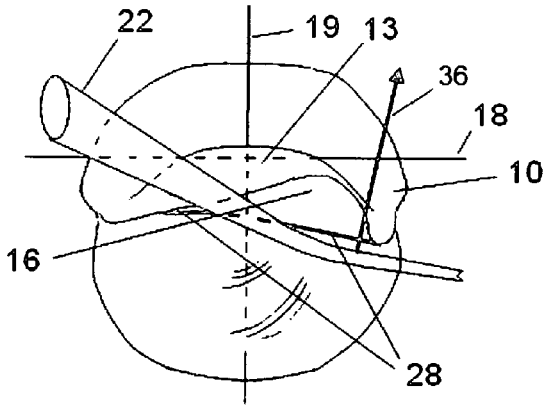

FIGS. 1, 4, and 5 show respectively a left side view, a top view, and a front view of the invention as it would appear in place upon the distal digit of a right thumb. For the remainder of the discussion the top view will be called the dorsal profile. Each view shows one or more axes passing through an actual human thumb. These axes in turn will be used as reference points to describe the angular orientation of the plane of its striking surface with respect to a horizontal reference plane on the thumb or finger. We will select a convenient reference point to be the point on the surface of the thumbnail and at the center of the dorsal profile of the thumbnail as seen in FIG. 4, and call this the center point (15). Through the center point we will first define a longitudinal axis Y which passes longitudinally along the length of the thumb traveling upon the mostly straight and horizontal surface of the thumbnail and continues in a straight line indefinitely. The position and direction of this axis can be seen in FIGS. 1 and 4. A second line traveling perpendicular to Y, also passing through the center point and parallel to the horizontal plane of the dorsal view of FIG. 4 will be called axis X. A third axis, perpendicular to both X and Y, passing through the center point, and running in a vertical direction defines axis Z. Axis Z can be more clearly seen in FIGS. 1 and 5. The preceding description of these three axes and their illustration in FIGS. 1, 4, 5, and 6 through 11 is deemed sufficient and will not be further described. At this point we will also define a plane XY which will be defined as the intersection of axes X and Y, and could be considered to be parallel with the plane of the dorsal view of FIG. 4.

Figure 3:
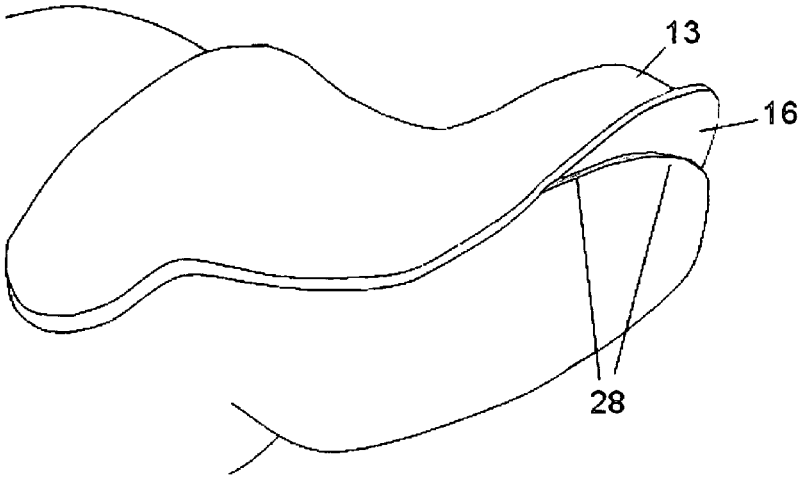

In addition to the three axes we will define the flange base edge (28) to be a curved line segment running along the lower edge of the flange at the place where it both contacts the finger and joins to the saddle. Refer to FIGS. 3 and 5 for illustrations of the flange base edge.

Figure 6:
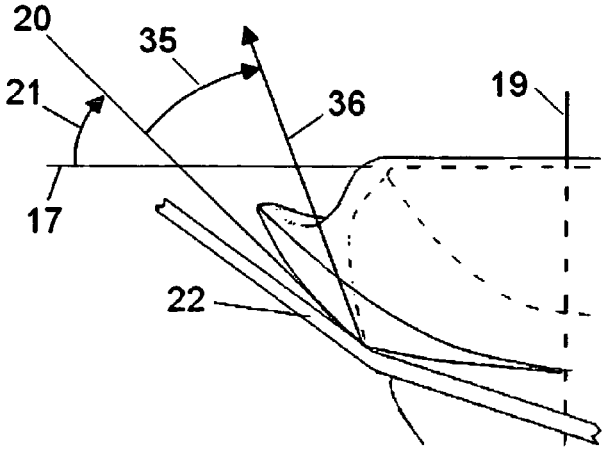
Figure 7:
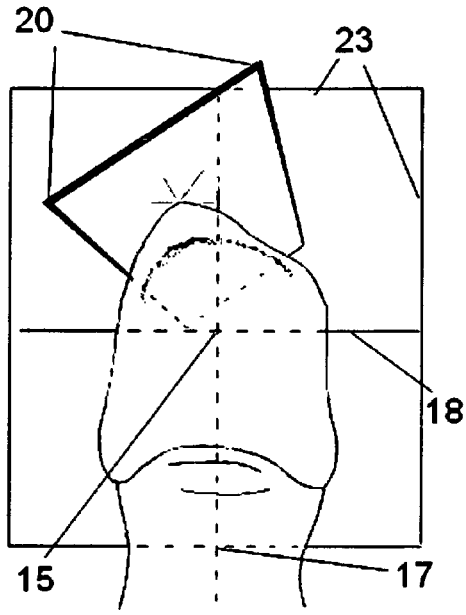
Figure 8:
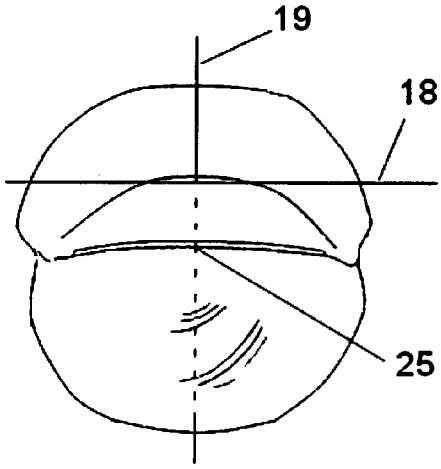
Figure 9:
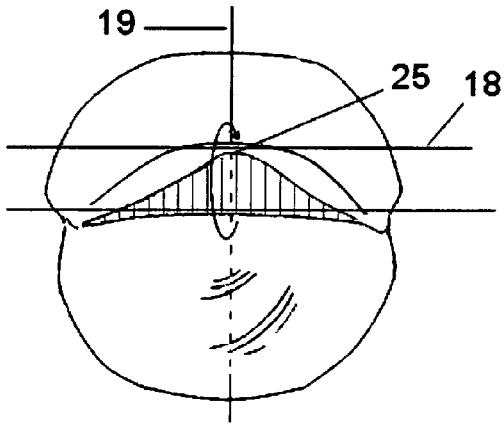
Figure 10:
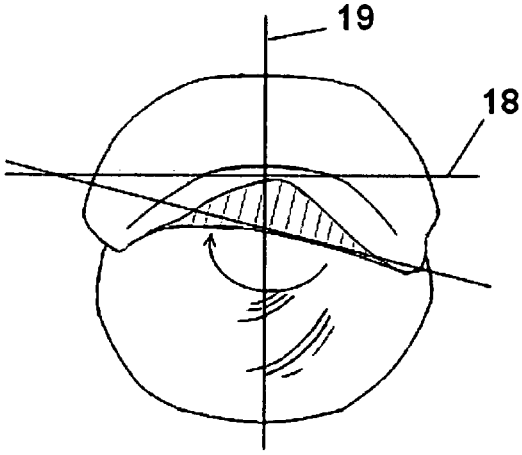
Figure 11:
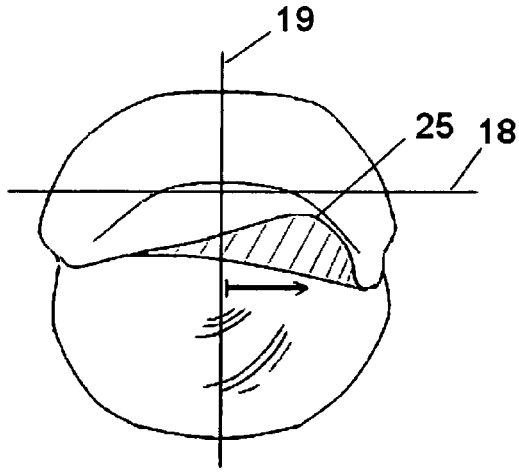

Now that we've properly defined reference points, reference lines, and reference planes we can begin to describe the shape, placement and angular orientation of the flange. The preferred embodiment uses a pick flange shaped similar to the end of a triangular flat pick which has a somewhat parabolic shape around the apex. The author has found the optimum parameters for the placement and angular orientation of the flange for the thumb to be similar to those shown in FIGS. 4 through 7, with FIG. 7 showing how the angular orientation of a pick for a right thumb would appear as viewed from a dorsal profile. The most straightforward way to describe the angular orientation of the pick flange would be to show the final angle as the result of a series of rotations of the pick flange around three axes parallel to the three coordinate axes X, Y, and Z. First consider a pick flange as shown in FIG. 8, the same front view as FIG. 5, but with its flat part lying within the XY plane, that is, perfectly horizontal to the fingernail, and the apex lying in the same plane as the YZ plane. The first rotation would be on a lateral axis parallel to the X axis and passing through the ends of the flange base edge (28). The result of this operation is the tilting upward of the pick flange as shown in FIG. 9. The second rotation would be around an axis parallel to the Y axis and passing through the apex. This would orient the pick flange as shown in FIG. 10. The last rotation would be around the Z axis, the final result of which is shown in FIG. 11.

The purpose of all the preceding description concerning both the placement and angle of the striking surface is to clarify this novel element of the invention. The desired result is twofold. First, the base of the pick flange must be largely parallel with the string as it first contacts the finger. Second, the plane of the striking surface must form a slight angle with plane of the moving string as it passes along the surface. This is illustrated in FIG. 6 which is an enlarged view of the fingertip area of FIG. 1. The direction of travel (36) of the string (22) is shown and the angle that it forms with the plane of the striking surface (20). Also it can be seen that the striking surface (16) forms an angle (21) with the horizontal plane of the fingernail (17), and that this angle is large enough that it does not inhibit the travel of the string across the striking surface.

Figure 21:
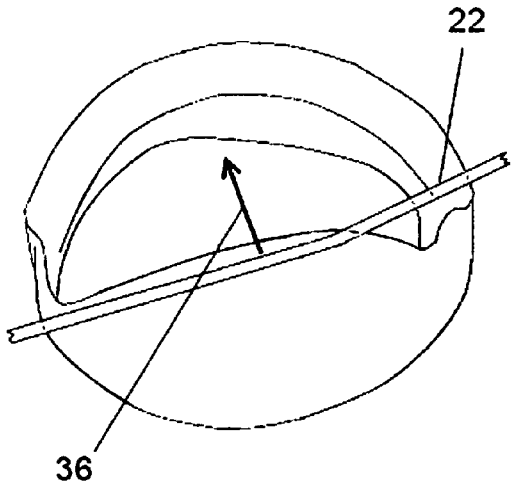
Figure 22:
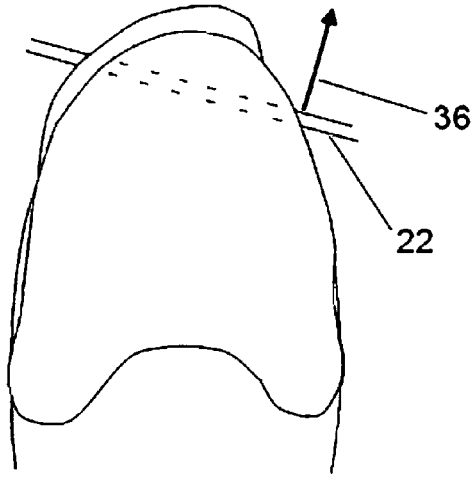

Prior discussion has concerned a pick of this invention for the thumb. A pick of this invention for the index finger or forefinger is shown in FIGS. 17, 18, 21, and 22. FIG. 17 shows a left side view of a right hand pick for the index finger, forefinger, or ring finger. FIG. 22 shows the eccentric placement of the pick to be to the right, or clockwise from the center of the finger as viewed from above. This is the opposite placement of the thumb pick, but, as in the thumb pick, is in general alignment with the direction of the string travel. Also, FIG. 21 shows that the angular orientation of the flange base is opposite that of the thumb, but follows the same rule of the thumb in that this flange base edge is parallel to the string as it contacts the finger, and perpendicular to the travel of the string.

Figure 14:
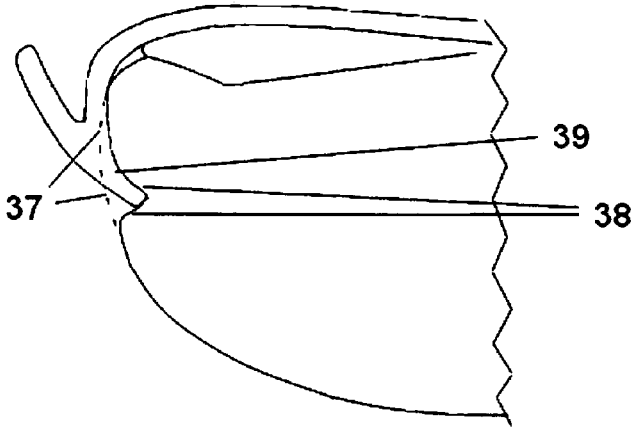

The retaining strip was defined previously as the lower, mostly vertical area on the tip of the saddle upon which the flange is attached. The retaining strip was described as following the contour of the fingertip down to its terminating edge as shown in FIGS. 23, 24, and 25. With the exception of a few cases, which will be explained later, the lower portion of the retaining strip must be modified for the invention to work properly. This simply involves forming the edge beginning a few millimeters above so that it breaks from the contoured surface of the finger and turns inward toward the finger, as illustrated in FIG. 14. This drawing is an enlarged cross section of the view of FIG. 1, in which the broken line (37) would be the natural contour of the finger. As a result of the modification, the new contour (38) of the fingertip is shown as it is being pushed in by the inward curving edge of the modification. The reason for this will be explained in the "operation" section of this specification.

At this point it would be helpful to describe the method of manufacture of the pick with attached flange. The author realizes that the drawings provided herein do only a limited job of showing the placement of the pick flange upon the pick. By briefly describing the process by which the picks are currently made the reader can get a much better understanding of how the final product looks and operates.

Figure 15:
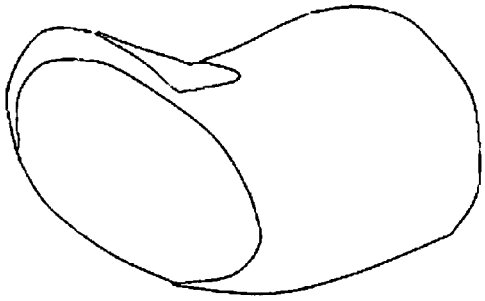
Figure 16:
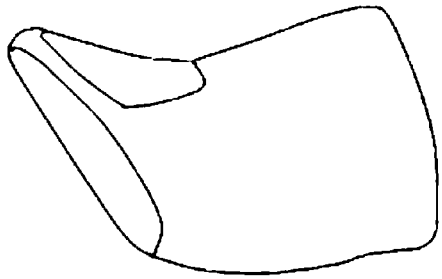

The process starts with a rubber finger made from a mold which is in turn formed from an actual finger. Then a slice of the rubber finger is made as shown in FIGS. 15 and 16. In the drawings it can be seen that the slice is a flat plane, and that the plane is at the same angle and position as the pick flange would be on the finished pick. This angle and position at which the slice is made in fact determines the placement and angular orientation of the pick flange. FIGS. 23 through 37 are on the same page and arranged in three columns horizontally across the page. Each column shows a different view of a right hand thumb pick. Each row going down shows a step in the process making the pick. The first row shows three views of an unmodified saddle. The second row shows a modified saddle formed from a rubber finger after the sliced surface has been made for attaching the pick flange. This sliced surface is made as a plane, which after the saddle is formed will be the planar surface upon which the pick flange will be attached. This planar surface is that which allows the pick to be placed at the angle of orientation, which has been described previously as a series of rotations of the pick flange. The third row shows three views of a pick flange. The fourth row shows the pick flange as it appears immediately following the attachment process. Currently hot air welding is used to perform the attachment. The last row shows three views of the finished pick. Finishing is accomplished by heating, forming, and attaching the "horseshoe" ends of the flange to the sides of the saddle, followed by removal of excess flange material to make the surface continuous and smooth.

It should be stated at this point that the formation of the saddle from the "plane sliced" finger model is the part that effects the inward curvature modification of the lower edge of the retaining strip. Refer again to FIG. 14 to see how this affects the unique shape of this part of the pick saddle.

The part of this invention that remains to be discussed is the elastic band which holds the pick in place. This invention is one of the very few which use a separately formed part as a securing means. The only prior art designs mentioned in this specification which do this are the Knutsen, Sielaff, and Coimbra picks, none of which have gained a wide acceptance. The elastic band of this invention is wide, very thin, and also contoured to the shape of the finger. It also provides an added benefit to the outer surface of the pick in that it is soft, has no hard edges, and eliminates the undesirable effects of hard edges. FIGS. 2, 18, 19, and 20 all show different views of picks on fingers with the elastic band in place.

Figure 19:
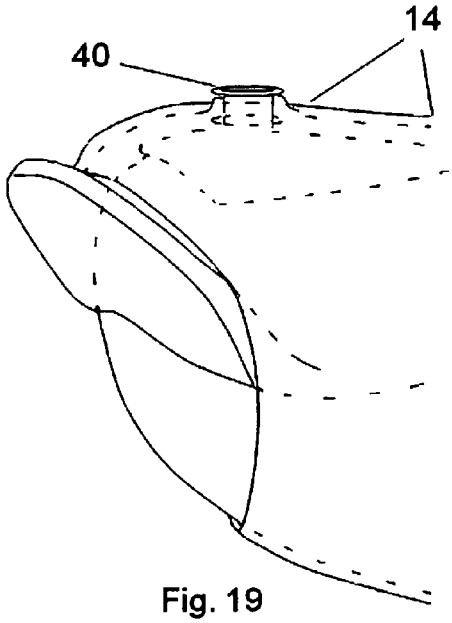
Figure 20:
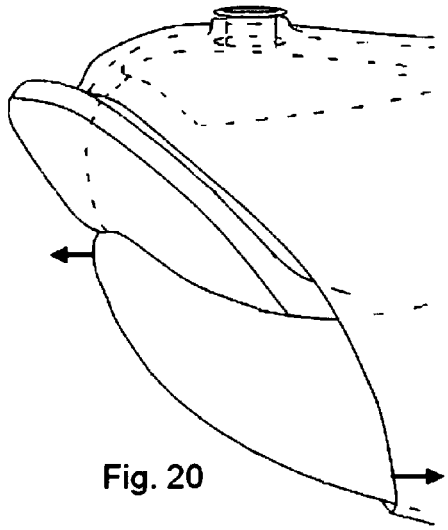
Figure 38:
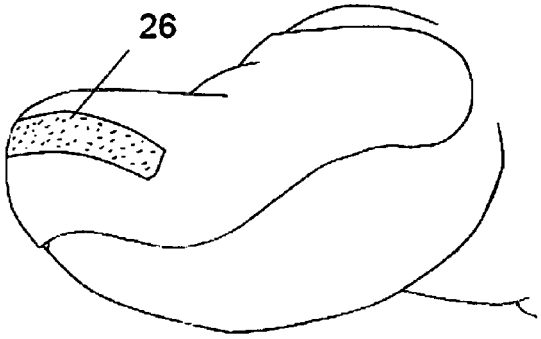

In addition to being a securing means for the pick saddle to the finger, the preferred embodiment also has the elastic band secured to the pick saddle. FIGS. 19 and 20 show a side view of a band secured to a pick saddle using an eyelet. An means of attachment is to use a traction strip attached to the saddle at the fingertip area. The traction strip, FIGS. 38 and 39, uses an abrasive surface which inhibits motion of the elastic band in the lateral and longitudinal directions. FIG. 38 is shown without the pick flange attached. Another method of securing the band to the saddle is by the use of an adhesive which is applied to the surface of the saddle at the same place near the fingertip area as the traction strip.

Operation—Main Embodiment

The pick of this invention has been designed to solve the problems outlined in the "background" section of the specification. The prior section was given to describe the shape, position, and angular orientation of the pick flange and the unique shape of the pick saddle to which the pick flange is attached. These design elements are the basis for the unique function of this invention, and it is this function which will be now be examined.

The pick is held securely in place on the upper (dorsal) surface of a distal digit (fingertip to first joint) of a picking finger. It is held securely by a strong elastic band which covers nearly the entire longitudinal length of the distal digit, and is as thin as possible. The preferred embodiment uses a band made of latex rubber less than 0.02 inches thick which is very stretchy and very strong. The relatively long width is needed to provide a large contact area with both the upper surface of the pick saddle and the lower surface of the distal digit. This combined with the contoured shape of the underside of the pick saddle allows a larger force applied by the band to secure the saddle in place. The unstretched band has a circumference of about 10 to 25% less than the finger and saddle, and must stretch enough to fit. The combined force is greater than that achieved by other finger picks that are formed as a single piece and are held in place by compressing and deforming the surface of the finger. The fact that the pick of this invention does not deform the upper surface of the finger is one reason that it does not cause pain. Another reason is that although the securing force is greater it is distributed over a much larger surface area. But most importantly, this larger surface area is an area which does not introduce pressure points because the special contoured surface eliminates pressure points and effectively equally distributes over the entire inner surface of the saddle the force required to hold the pick in place. This is what makes the pick very comfortable to wear.

Two more advantages of the elastic band must be discussed. One is it's part in allowing another novel aspect of the invention to be effective. This would be the retaining strip of the saddle. When the pick is put in place on the finger or thumb, it is done by pulling the elastic band over the fingertip end of the saddle, and then working back toward the rear of the saddle which is closest to the joint of the finger. The object is to pull the band back far enough toward the finger joint so that the end of the band settles into the somewhat recessed area of the joint on the underside of the finger. This positioning helps to keep a lengthwise tension (along the Y axis) which will pull the pick saddle toward the finger joint and lock the retaining strip onto the fingertip. This not only prohibits the saddle from sliding forward during use, but more importantly also pulls the lower edge of the flange (at the flange base edge) into a snug contact with the underside of the finger, eliminating a potential gap between the flange and finger. FIGS. 19 and 20 illustrate the action of the elastic band as it pulled back toward the hand. FIG. 19 shows the elastic band in place on the pick saddle and finger. The saddle is shown with an optional band securing means installed on the front near the fingertip. When the band is pulled back longitudinally toward the hand, the saddle in turn is pulled until the lower edge of the retaining strip is snug in it's contact with the finger. The idea is to make it snug enough that the contacting edge of the retaining strip creates a slight pucker of the skin. FIG. 20 shows this dynamic. This aids greatly in preventing a string which is passing over the surface of the finger from becoming snagged on a loosely secured flange base edge.

The second advantage of the elastic band is that the soft composition of the band creates an external surface that is also soft. This had an enormous advantage as the fingers are plucking strings and sometimes inadvertantly hit adjacent strings. The soft exterior of this invention acts as a muffling device and keeps the adjacent strings from vibrating and making unwanted sounds while the user is playing his instrument. Absolutely no other popular pick commercially available at the time of this writing incorporates this advantage. This part of the invention solves much of prior art problems of creating unwanted noise while using a pick device.

When a stringed instrument is plucked relatively large forces are applied to the small striking surface of the picking device. Consider as an example a force of between 1 and 5 lbs applied to a string as it is pulled prior to being released. This is force that is applied at an angle to the striking face of the pick, and would cause the pick to both lift upward and to shift laterally if it was not adequately secured. Indeed this does happen with many prior art designs so that the user has to deal with picks that dislodge and occasionally fly off, or that need frequent readjustment. The pick of this invention eliminates "fly off" due to the securing action previously described, and greatly reduces the need for readjustment because the inner surface contour of the pick saddle reduces lateral movement.

As explained previously, most of the popular picks (Dunlop pick, Fred Kelly Freedom pick, Thornhill pick, and others), with the exception of the Alaska pick, use a pick flange originating from a pick body which is mounted on the lower surface, or contact surface, of the finger. This creates a good sound and eliminates the problem of a string crossing the junction of two surfaces where a potential string hangup could occur. But, as mentioned previously, the penalty of this design is the loss of finger sensitivity with the string. This invention uses a pick flange placement which does not interfere with the touch of a player's finger upon the string.

When the pick is in place the player uses the instrument normally as he would without any modification to his playing style. Although the latex band covers much of the lower surface of the finger he will notice that he can still adequately feel the placement of the string. This is due to the flexibility of the thin latex band. He will notice after a short while that he has made changes to his style to accommodate the different shape of his new distal digits. The author has found that an additional enhancement to the playing experience of the invention is the application of a small amount of oil onto the latex surface which contacts the strings. The author uses silicone oil, also known as dimethyl silicone. This greatly reduces the friction of the latex with the strings and make for a very fluid, effortless playing experience.

Description and Operation—Alternative Embodiments

Up to this point the invention has been described as illustrated in the drawings of FIGS. 1 through 19. The pick saddle has been described and illustrated as a contoured surface and this surface has been modeled after the authors own fingers and thumb. The author recognizes that a pick of this invention constructed in such a way will not suffice for the multitude of sizes and shapes of fingers and thumbs of individuals who will need a construct of this invention to fit their own fingers. Several solutions of this problem come to mind. The first involves making a number of sizes of pick saddles for thumbs and fingers made from models of persons of a range of finger sizes. A person wishing to purchase a pick of this invention would choose a size closest to his finger or thumb size. A second solution of the size problem brings to mind an alternative embodiment of this invention. A pick saddle that does not resemble the pick saddle of the drawing figures could be constructed but still able to cover a substantial part of the dorsal profile of a distal digit. This could be constructed as a single size or generically sized as small, medium, and large. The saddle would be purchased by the end user with the intent that the end user would modify the interior surface of the generic sized saddle so that it will be contoured to the individual's finger. This would be accomplished by application of a small amount of epoxy putty or a like moldable substance which would be placed upon the dorsal surface of the distal digit of the end user's finger, followed by placement and compression of the generic pick saddle upon the putty on the distal digit. Upon hardening of the epoxy putty the excess putty would be trimmed off and the pick could be used with the same advantages of the main embodiment of the pick saddle of this invention. The disadvantage of this embodiment is that a generic "one size fits all" saddle template would most likely require the user to purchase a saddle template considerably larger than the profile of his finger, and would add unwanted extra mass to the surface of the pick, and introduce the problem of inadvertent contact with adjacent strings when the user is playing his instrument.

Figure 40:
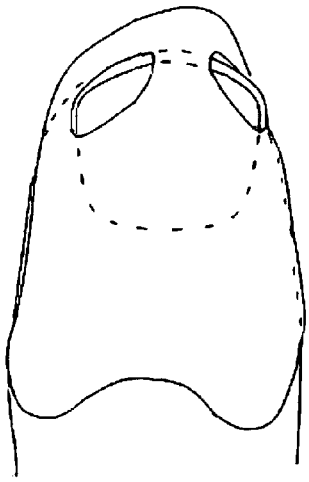
Figure 41:
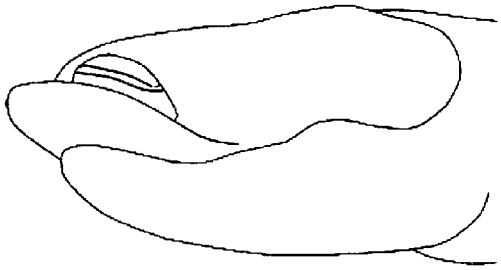

Another alternate embodiment involves the design of the retaining strip. The preferred embodiment has shown the retaining strip to be a an uninterrupted continuation of the pick saddle as it follows the surface features of the finger, leaving the dorsal profile of the finger, and proceeding downward over the anterior end of the finger. FIGS. 40 and 41 show an alternate embodiment in which a part of the retaining strip has been removed, leaving a gap as shown at the fingertip region, with only a narrow part of the retaining strip remaining. This gap on the retaining strip allows the saddle to be pulled tighter in the longitudinal direction toward the base of the finger. This creates an additional advantage in a more snug fit of the flange base edge with the lower finger surface, eliminating a chance of the string hanging on this edge.

Figure 42:
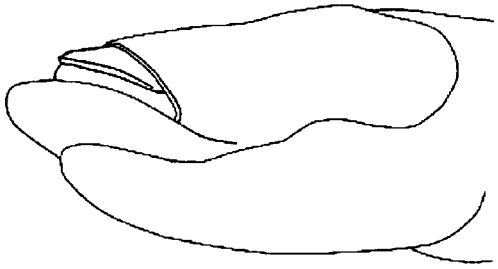
Figure 43:
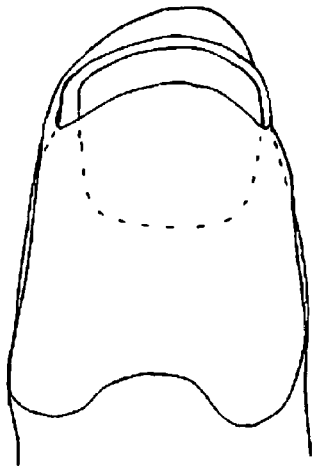

Similarly an additional alternate embodiment removes the entire upper portion of the retaining strip, see FIGS. 42 and 43, leaving the fingertip to extend through the opening that is made. This creates an advantage of a much lower profile of the pick and minimizes the chances of the user inadvertently contacting adjacent strings. This embodiment also allows the pick saddle to be pulled further toward the base of the finger, effecting a tighter conformation of the flange base edge with the finger.

Figure 44:
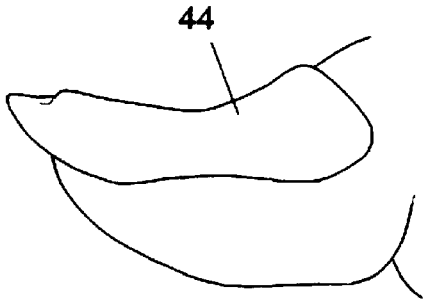
Figure 45:
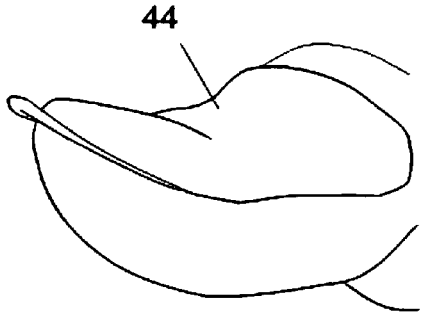

The preferred embodiment has a retainer strip as part of the pick saddle construction, forming a cupped shaped cavity which is very useful in securing the saddle in place. An additional alternate embodiment omits the retaining strip entirely, with the anterior boundary of the pick saddle ending at what can be seen in the dorsal profile view of FIG. 13. A saddle formed in such a manner is shown in FIGS. 44 and 45. The pick flange in this case is attached nearly on the same plane as the fingernail. This embodiment works satisfactorily for a thumb, but has some problems when used with other fingers.

Another alternative embodiment uses a pick saddle and flange formed together as a single piece from a mold. The advantage of this embodiment is that after a number of pick molds of a range of sizes of picks of this invention have been created, then large numbers of picks could be created using automated manufacturing techniques, such as injection molding. A person desiring to purchase a pick would choose a size that fits from a much larger selection. This would allow him to have a low profile pick that fits, and would allow him to purchase it for a much lower cost than the embodiment described herein, in which the saddle and pick flange begin as separate pieces.

CONCLUSION

The invention has been shown to solve the problems that have been inherent with finger type picks since the first ones were made. Flat picks have remained popular because they produce a pleasing, distinct sound, featuring clarity and volume. Finger picks have always attempted to reproduce the same sound, but have fallen short for many of the reasons listed in the beginning of this specification. This invention succeeds in reproducing the flat pick sound by the unique shape and placement of the pick flange. It eliminates the frustration users encounter when they try finger picks for the first time and discover that they must relearn their picking technique. The contoured shape of the inner surface of the pick saddle which mimics the natural surface contour of human fingers and thumbs makes for a pick that is very comfortable to wear and wonderfully stays in place. In addition, the author happily discovered that using this pick allows him to produce and experiment with different sound combinations that were not heretofore possible.

The finger pick of this invention is a device that is simply very comfortable, stays in place, and is a joy to play. It produces such a marvelous sound that it is anticipated that many flat pick users will try this and decide to permanently give up flat picking altogether. Since one pick of this invention produces the same sound as one flat pick, those who use flat picks will discover that a combination of three picks will open up an entirely new world and allow them to experiment with new sounds that had not been possible for them before.

DRAWING FIGURES

FIG. 1 Left view (toward the player) of the distal digit of a right hand thumb with the pick in place on the thumb but shown without a pick securing means.

Figure 2:
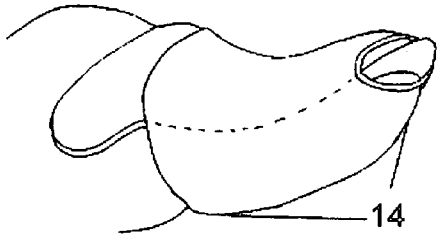

FIG. 2 Lower right view of FIG. 1 thumb and pick with securing means in place.

FIG. 3 Enlarged view of FIG. 2 without securing means, showing the flange base edge as it conforms to a snug fit on the lower fingertip.

FIG. 4 Dorsal profile (top view) of the distal digit of a right hand thumb with pick in place without securing means.

FIG. 5 Front view of distal digit of right hand thumb with pick

FIG. 6 Enlarged view of FIG. 1 showing the fingertip area of a right hand thumb with pick.

FIG. 7 Same dorsal profile as FIG. 4, also showing the orientation angle of the striking surface (16) of the pick for a right hand thumb.

FIG. 8 Same as view as FIG. 5 but having the pick flange in a horizontal position parallel with the XY plane.

FIG. 9 Same view as FIG. 5 but with pick flange rotated upward around an axis parallel with the X axis. This would be the first rotation of the series of three which define the orientation angle.

FIG. 10 Same as FIG. 9 but with the pick flange rotated clockwise around its longitudinal center on an axis parallel with the Y axis. This is the second of the series of three rotations which define the orientation angle.

FIG. 11 Same view as FIG. 10 but with the pick flange rotated counterclockwise around an axis parallel to the Z axis, as it would appear in a dorsal view. This is the third of the series of three rotations which define the orientation angle.

FIG. 12 Left side view of a distal digit of a right hand index finger, forefinger, or ring finger showing the contour features, or surface features which the invention incorporates into the inner surface of the pick saddle.

FIG. 13 Top view or dorsal profile of the distal digit of a right hand thumb, with a curved arrow indicating the curvature of the fingertip area that is a part of the surface features incorporated into the inner surface of the pick saddle.

FIG. 14 An enlarged cross sectional left sideview of a distal digit of a right hand, showing the critical design feature of the preferred embodiment of the retaining strip, in which the lower edge of the retaining strip is turned inward toward the finger so that a tight fit can be achieved when the elastic band is properly in place.

FIG. 15 Left front view of a model of a right hand thumb which has been sliced prior to forming the pick saddle. The angle and position of the slice allow attachment of the pick flange at the proper predetermined orientation angle.

FIG. 16 Side view of same model as FIG. 15.

FIG. 17 Left view of the distal digit of a right hand index finger, forefinger, or ring finger with a pick showing an instrument string and it's direction of travel across the striking surface of the pick pick flange.

FIG. 18 Same view as FIG. 17 without the string but showing the elastic band in place.

FIG. 19 Enlarged view of the fingertip region of FIG. 18 showing an optional eyelet installed on fingertip area of the pick saddle, the eyelet used to secure the elastic band in place as it is pulled toward the base of the finger.

FIG. 20 Same view as FIG. 19 but showing the result of pulling the elastic band toward the base of the finger allowing the flange base edge to make a tight fit with the finger. The upper arrow indicates the direction the finger is moved with respect to the flange base edge, and the lower arrow shows the direction the elastic band is pulled as it is properly installed.

FIG. 21 Front view of the distal digit of a right hand index finger, forefinger, or ring finger with pick, showing also the angle of orientation of the pick flange to be such that the flange base edge is mostly parallel with the string as it first encounters the finger.

FIG. 22 Top view, or dorsal profile of the same item as FIG. 21, highlighting the same features as described in FIG. 21 description.

FIGS. 23-37 Series of drawings showing three views and five steps of a process which is one way to construct the pick of this invention. The three views are arranged in three columns across the top, and the five steps are rows arranged in order of the process from top to bottom.

FIG. 38 Left front view of the distal digit of a right hand thumb shown with a pick saddle with pick flange omitted for clarity. Also showing a traction strip (26) used to hold the elastic band in place as it is pulled toward the base of the finger.

Figure 39:
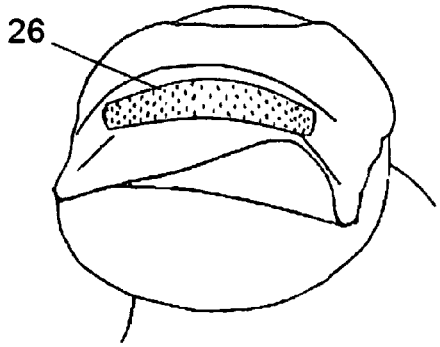

FIG. 39 Front view of the distal digit of a right hand thumb shown with a complete pick saddle also showing the traction strip (26) of FIG. 38.

FIG. 40 Dorsal view of one alternate embodiment of this invention on a right hand index finger, forefinger, or ring finger. The upper part of the retaining strip has been opened up so that only a narrow strip of the original remains.

FIG. 41 Front left view of the same item as FIG. 40.

FIG. 42 Left front view of another alternate embodiment of this invention on a right hand index finger, forefinger, or ring finger. The entire upper portion of the retaining strip has been removed, the only part remaining is the lower part to which the pick flange is attached.

FIG. 43 Dorsal view of the same item as FIG. 42.

FIG. 44 Left side view of a third alternate embodiment of this invention on a right hand thumb which does not have the retaining strip as part of the pick saddle. The pick flange instead is attached at nearly the same plane as the fingernail.

FIG. 45 Left front view of the same item as FIG. 44.

FIG. 46 Underside view of a prior art pick which uses a concave surface as a striking edge.

LIST OF REFERENCE NUMERALS

10. The pick saddle constitutes the bulk of the pick and consists of a sheet of material of which the underside has the contour of the upper surface of a distal digit of a human finger.

11. The pick flange is a thin, flat sheet of material roughly in the shape and size of a triangular flat pick. It is attached to the saddle at the lower portion of the retaining strip (13).

12. The pick edge is the area which could be described as a curved line segment which lies at the junction of the lower and upper surfaces of the pick flange and is the place at which the instrument string is released at the moment it is plucked.

13. Retaining strip is the area of the pick saddle which extends over the end of the fingertip and runs roughly in a downward direction and terminates with its lower edge contacting the lower surface of the finger.

14. The securing means is an elastic band which secures the pick saddle on the finger.

15. The center point is used as a reference point for describing the coordinate axes. It is an arbitrary point fixed at approximately the center of the surface of the fingernail as seen from the dorsal profile.

16. The under surface of pick flange called the striking surface. This is the part that contacts the string.

17. Longitudinal axis Y which passes in the direction of the length of the finger or thumb, dividing the finger into equal longitudinal halves, and passing along the surface of the fingernail.

18. Lateral axis X which perpendicularly intersects Y at a point on the Y axis where the fingernail reaches its maximum width.

19. Vertical axis Z which runs perpendicular to both X and Y and intersects at the same intersection of X and Y.

20. A plane tangent to the striking surface at the flange base edge. This plane defines the angular orientation of the striking surface with respect to the three coordinate axes X, Y, and Z. This plane can be characterized as a series of rotations of about these coordinate axes.

21. The XY angular offset is the rotation of the pick flange in the upward direction toward the Z axis. It could also be described as the angle at which the striking surface is tilted with respect to the horizontal plane (XY) of the fingernail.

22. Instrument string.

23. XY plane formed by the intersection of the X and Y axes.

25. The apex of the pick flange.

26. A traction strip used as a securing means of an elastic band to the fingertip region of the pick saddle.

27. Fingernail surface includes the slightly convex shape as seen in a front view.

28. The flange base edge is a curved line segment which lies at the edge of the pick flange at the point where the flange joins the pick saddle.

29. Raised area behind (posterior to) the finger.

30. Curved or cupped, mostly vertical area defining of the finger surface as it leaves the dorsal profile and proceeds downward, terminating at the boundary between the dorsal and ventral halves of the finger.

31. Indicates the general curvature of the dorsal part of the distal digit as it would be seen in a front view.

32. Curvature of the fingertip as it appears in a dorsal profile of the distal digit of a finger or thumb.

33. Boundary between the dorsal and ventral halves of a distal digit.

34. The dorsal surface of a distal digit.

35. Angle between the line of travel of the string (36) and the plane of the striking surface (20) called the striking angle.

36. Arrow indicating the direction of travel of the string prior to contacting the finger or the striking surface.

37. Line showing the natural contour of the fingertip.

38. Line showing fingertip pushed in by a modified retaining strip with its terminating edge curving inward

39. The lower edge of a modified retaining strip, shown as it departs from the natural contour of the fingertip.

40. Eyelet attaching an elastic band to the upper fingertip area of the pick saddle.

41. Flat area formed on retaining strip so that the pick flange will have the desired orientation angle when it is attached to the pick saddle.

42. Prior art pick which uses a concave surface as a striking edge.

43. The edge of pick of (42) which plucks the strings.

44. Pick saddle which does not have a retaining strip in which the pick flange is such that the plane of the striking surface is nearly at the same angle and position as the fingernail.

We claim:

1. A means of equal distribution of force exerted by a picking device upon a distal digit of a human finger or a human thumb, said picking device being worn on said distal digit of a player of a stringed musical instrument to aid in the plucking of said stringed instrument, said finger or thumb having a dorsal surface and surface features, said force being exerted to hold said picking device securely upon said distal digit, said means of equal distribution of force comprising a pick saddle constructed of a sheet of a hard material, said pick saddle covering a substantial portion of said dorsal profile of said distal digit, said pick saddle having an inner surface, said inner surface having surface features which mimic said dorsal surface features of said distal digit, said pick saddle having a fingertip region, said saddle incorporating a pick flange at the fingertip region of said saddle, and a securing means of said saddle to said distal digit in a manner that said surface features of said inner surface of said saddle are held in close contact with said surface features of said distal digit, whereby said picking device is comfortable to the user, does not dislodge from it's position on said distal digit during use, and eliminates much unwanted noise when adjacent strings of said stringed instrument are inadvertently contacted.

2. A means of equal distribution of force of claim 1 wherein said pick saddle incorporates a retaining strip on said fingertip area of said saddle, said retaining strip having a flange base edge, said pick flange attached to said retaining strip at said flange base edge of said retaining strip whereby effecting a more natural playing experience and prohibiting unwanted displacement of the picking device in the longitudinal direction of said distal digit.

3. A means of equal distribution of force of claim 2 wherein said retaining strip has a lower portion, said lower portion of said retaining strip is turned in a radial direction inward toward said distal digit whereby effecting a tight conformation between said flange base edge and said distal digit, and minimizing the chance of a string of said stringed musical instrument snagging on said flange base edge.

4. A means of equal distribution of force of claim 2 wherein said pick flange has a striking surface, said striking surface having a predetermined angular orientation, whereby a picking dynamic is facilitated which more closely approaches that of an unaided finger.

5. A means of equal distribution of force of claim 1 wherein said securing means comprises an elastic sleeve having a length approximately the length of said distal digit.

6. A securing means of claim 5 wherein said elastic sleeve incorporates a secondary securing means which secures said elastic sleeve to said pick saddle.

7. A device of claim 6 wherein said secondary securing means is selected from a group consisting of rivets, eyelets, snaps, and grommets.

8. A device of claim 6 wherein said secondary securing means is selected from a group consisting of adhesives.

9. A device of claim 6 wherein said secondary securing means is a traction strip.

10. A means of equal distribution of force of claim 2 wherein said retaining strip has an upper portion, said upper portion being removed in a way that two cavities are created, whereby said flange base edge of said pick saddle can be held in closer conformation with said distal digit.

11. A means of equal distribution of force of claim 1 wherein said hard material is selected from a group consisting of plastic polymers and epoxies.

12. A means of equal distribution of force of claim 1 wherein said hard material is selected from a group consisting of metals and metal alloys.

13. A means of equal distribution of force of claim 1 wherein said hard material is selected from a group consisting of ceramics.

14. A device of claim 5 wherein the composition of said elastic sleeve is selected from a group consisting of elastomers.

15. A means of equal distribution of force of claim 2 wherein said retaining strip has an upper portion, said upper portion being removed, whereby said pick saddle is smaller and minimizes the chance of said pick contacting an adjacent string.

* * * * *